United States Patent [19]

Kovach

[11] Patent Number: 4,551,985

[45] Date of Patent: Nov. 12, 1985

[54] RINK COVERING STRUCTURE

[76] Inventor: Bruce F. Kovach, 5918 Radnor, Detroit, Mich. 48224

[21] Appl. No.: 590,835

[22] Filed: May 3, 1984

Related U.S. Application Data

[62] Division of Ser. No. 407,031, Aug. 11, 1982, Pat. No. 4,467,619.

[51] Int. Cl.[4] ..... A63C 19/10

[52] U.S. Cl. ..... 62/235; 62/260; 126/415; 165/45; 405/130; 405/217

[58] Field of Search ..... 62/260, 235; 165/45; 405/130, 217; 5/417, 420; 126/415

[56] References Cited

U.S. PATENT DOCUMENTS

| | | | |
|---|---|---|---|
| 2,587,855 | 3/1952 | Johnson | 62/235 |
| 2,961,840 | 11/1960 | Goldtrap | 62/260 |
| 2,997,770 | 8/1961 | Beltz | 62/235 |
| 3,251,194 | 5/1966 | Walker | 62/235 |
| 3,538,719 | 10/1970 | Pradel | 62/235 |
| 4,038,834 | 8/1977 | Roberts | 62/235 |
| 4,057,967 | 11/1977 | Hill | 62/235 |
| 4,174,009 | 11/1979 | Laing et al. | 165/45 |
| 4,402,305 | 9/1983 | Kremen | 126/415 |

FOREIGN PATENT DOCUMENTS

| | | | |
|---|---|---|---|
| 2840021 | 3/1980 | Fed. Rep. of Germany | 5/455 |

*Primary Examiner*—Ronald C. Capossela

[57] ABSTRACT

A method for creating an ice-skating rink comprising an excavation in the ground lined with polyethylene and filled with salt water; a pump and sprayer used in the winter to build up a layer of salt ice on top of the salt water and to eventually fill the excavation with frozen salt water in this manner, with the pump drawing salt water from beneath the salt ice as the freezing process progresses; covering the salt ice with a layer of straw or layers of air supported reinforced plastic during the warm weather months; circulating air or water over the salt ice and then through channels cut into the ice of the ice rink; laying aluminum foil on the skating surface and freezing more ice over it; and providing an enclosed air supported bubble over the ice with a secondary air supported inner ceiling having an upper facing aluminum surface thereon to reflect infrared radiation coming from the main outer bubble.

4 Claims, 11 Drawing Figures

RINK COVERING STRUCTURE

This is a division of application Ser. No. 407,031, filed 08/11, 1982 now U.S. Pat. No. 4,467,619.

FIELD OF INVENTION

This invention relates to a method for creating an indoor or outdoor ice slab and using frozen salt water, which is collected in the winter, to cool the ice slab during the warm months of the year.

DISCUSSION OF PRIOR ART AND SUMMARY

Heretofore year-round ice rinks have been almost universally maintained by either electric or gas refrigeration systems which circulate a refrigerating fluid through tubes or pipes located beneath the ice rink surface. These pipes are usually spaced some distance apart. Because of the distance the cold must travel from each pipe to maintain the frozen ice surface, the refrigerant must be much colder than the 32 degrees melting point of the ice surface. Additionally, because each coolant pipe must cool a large surface area of ice, the coolant in the pipe is warmed considerably as it flows under the ice and consequently must be cold enough when it enters the pipe under the rink so that it remains cold enough to freeze all of the ice surface above until it exits from under the ice surface. To maintain freezing ice surface temperatures the coolant temperature may have to be as cold as 10° depending on the heat load on the ice surface. It is well known that adding salt to water or ice lowers its freezing and melting temperature. Freezing a large quantity of water during the winter, then adding salt to lower its melting point to about 10° in order to use it as a refrigerant for an ice rink during the warm weather months will certainly work, however, it requires a great deal of salt to lower the melting temperature of the ice to 10° or so and all Of the salt water must be disposed of at the end of the year as the salt cannot be recovered easily from the water. It would be preferable then to re-freeze the same salt water year after year. However, since the salt water would only begin to freeze in 10° temperatures there would be few places in the United States having cold enough winter temperatures to freeze enough salt water at this temperature to last through the summer months when used to cool the ice rink. It is apparent then that providing refrigeration to a standard rink layout using frozen salt water is generally impractical. It further follows, however, that if heat load on the ice were reduced or cold transfer through the ice surface from the coolant were improved, the coolant would not have to be so cold to maintain the ice rink surface, less salt would be needed in the water, and at a warmer freezing temperature of the salt water, say, 26° there would be enough below 26° temperatures in many parts of the United States to freeze enough salt water to provide refrigeration for an ice rink through the warm months of the year. This invention, in one embodiment, reduces the heat load on the ice by providing an air supported bubble with a secondary inner ceiling of reflective aluminum facing upward to reflect infrared radiation coming from the ceiling back to the ceiling thus preventing it from heating the ice surface. Additionally, the bubble is lined with polyethylene sheet taped at the seems to seal the bubble airtight and in this way avoid the need to be continually blowing warm moist air into the bubble which readily forms condensation on, and puts a heat load on the ice surface of prior art ice rinks. In a further embodiment of this invention channels are cut in the ice surface and layers of polyethylene sheet are laid in the channels, coolant is circulated through the channels and between the polyethylene sheets, and ice is built up over the upper layer of polyethylene sheet. All this is done to improve the cold transfer of the coolant to the ice to the maximum possible as the coolant between the plastic sheets makes contact with the entire surface area of the ice only about 1½ in. below the skating surface. Coolant circulation capacity is also greatly increased by this design resulting in much less warming of the coolant as it passes under the ice surface. This combination of better cold transfer and less warming of the coolant permits the use of the warmer coolant temperatures such as can be supplied from a frozen salt water system. In the past the prior art of ice rinks describes a process to reduce radiant heat load on the ice surface by painting the ice surface white to reflect radiant energy, then building up a layer of ice over the white paint to provide the skating surface. White paint is very reflective of radiant heat emitted from high temperature sources such as electric lights and the sun. It is not as reflective of radiant heat from low temperature sources such as the inner roof and walls of a building. In fact, as the wave length of the radiation increases from being very short in the visible spectrum to becoming longer in the infrared range the white paint absorbs more and more of the longer wave infrared radiation until it begins to absorb more of the very long wave infrared radiation then it reflects. Surprisingly, aluminum, along with certain other more expensive metals in their polished states, such as bronze, copper and gold, act completely opposite to white paint, becoming more reflective as the radiation wave length increases. Aluminum is about 90% reflective in the visible light range with the figure rising to about 97% reflectivity of an aluminum surface reflecting long wave infrared radiation. Taking this into account, an important part of this invention is to cover the ice surface with a layer of aluminum foil to reflect both visible and infrared radiation and to freeze more ice over it to form the final skating surface.

DETAILED DESCRIPTION

Figure 1:
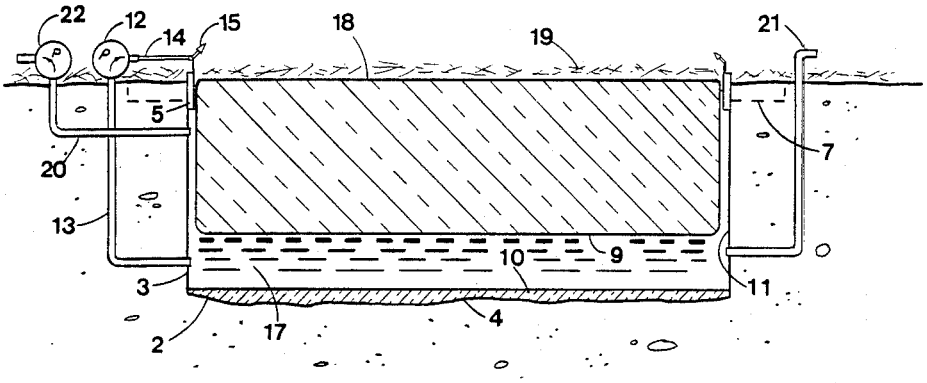
FIG. 1. is a cross-sectional view of a plastic lined excavation in the ground for the purpose of holding and freezing frozen salt water throughout the year.

In FIG. 1 an excavation in the ground is indicated by the number 2. The excavation 2 is rectangular, having vertical side walls 3. The excavation 2 must be at least as wide at its bottom as it is at its top. After the excavation 2 is dug and the dirt of its side walls 3 is smoothed, a layer of ice 10 may be frozen in the bottom 4 of the excavation 2 in order to seal the bottom 4 of the excavation 2 from any salt water leakage and to provide a smooth surface for an inner waterproof liner 11, which may be made of polyethylene, to rest against. The liner 11 covers the bottom 4 and sides 3 of excavation 2 and is filled with water to which salt is added. During freezing winter weather a sprayer pump 12 draws the salt water 17 through a pipe 13 from the bottom of excavation 2 and distributes it through a hose 14 to nozzles 15 around the perimeter of the excavation 2. The nozzles 15 spray the salt water 17 out over the salt water 17 in the excavation 2 building up a layer of frozen salt water or salt ice 9 which gets progressively thicker through the winter until it fills the excavation 2. Fender boards 5 secured by braces 7 run along the top edges of the excavation 2 and keep the salt ice 9 from rubbing against the side walls 3 of the excavation 2. Even though the side walls 3 are just dirt they need no support because they are soon frozen by the cold salt water 17 in the excavation 2. Before the side walls 3 are completely frozen it is desirable to soak the ground around the perimeter of the excavation 2 with water so that when it freezes it will form a water tight barrier to any salt water leakage from the excavation 2. After the excavation 2 is filled with salt ice 9 and melting spring temperatures arrive, the salt ice 9 is first covered with a sheet of polyethylene 18 to drain away any rainfall which would otherwise dilute the salt water 17 in the excavation 2. Then the salt ice 9 and the ground within about 10 feet of the excavation 2 is covered with a layer of straw 19 or its equivalent to provide for insulation of the salt ice 9 through the warm weather months. The excavation 2 has a salt water intake pipe 20 at one end of the excavation 2 and a salt water return pipe 21 at an opposite end of the excavation 2. A pump 22 connected to the intake pipe 20 circulates salt water to the ice rink of FIG. 5 or to the heat exchanger of FIG. 3, and back through the return pipe 21, thus providing refrigeration directly to the ice rink surface of FIG. 5 or indirectly through the heat exchanger of FIG. 3 to the ice rink of FIG. 10. The amount of salt added to the water in the excavation 2 controls the freezing and the thawing temperature of the water and this freezing temperature can be well below 32° in northern climates with very cold winters but must be closer to 32° in places with more mild winters. Normally a freezing temperature of the salt water 17 of 25° to 28° is desirable which requires about a 3% to 4% salt solution. The depth of the excavation 2 is determined by the amount of salt ice that can be built up in one winter season, which varys according to the local climate. The volume of the excavation 2 is determined by the total amount of refrigeration needed through the year plus a margin of safety. The main purpose of using this system over using a conventional rerigeration plant is to reduce the energy costs of running the rink. It is of equal importance that this system is non-poluting and wastes no natural resources, a novelty which will attract many people. It is also of major importance to avoid having to pay for future steep increases in energy operation costs which might make a conventionally refrigerated rink unprofitable. The above described refrigeration means can be used with conventional indoor ice rinks in very cold climates where the salt water 17 freezing temperature can be reduced enough to be used in a conventional ice rink system. This system is meant to be used year after year by refreezing the salt water 17 every winter. At the beginning of each winter, when most of the salt ice has been melted by its use in keeping an ice rink refrigerated through the past warm weather months, the straw 19 and the polyethylene sheet 18 are removed and the winter spraying and freezing procedure is repeated. A wide range of plastic based sheet materials are available for use as the excavation liner 11 and the salt ice cover 18. The main requirement is that they be impregnable to water and that any seams in the sheet also be made waterproof by either glue or waterproof tape or their equivalents. In mild climates, where there is not enough freezing winter weather to fill the excavation 2 with frozen salt water 1, a large area of ground can be leveled and frozen over with a few inches of ice, then salt water can be frozen over the ice by spraying or flooding. The frozen salt water can then be scraped off the ice surface and deposited in the excavation 2 by using conventional snow removal means since the salt water does not freeze solidly like the ice layer beneath it is frozen. In northern areas of very cold winter temperatures it may be possible to dispense with the sprayer pump 12 and its associated sprayer system entirely as enough frozen salt water may be frozen in the excavation 2 by natural freezing where the salt water 17 in the excavation 2 freezes from the top down. The purpose of the salt water pump and sprayer system after all is to make possible the building up of a greater thickness of frozen salt water 9 than would naturally occur by maintaining a layer of unfrozen salt water over the frozen layer of salt water 9 where freezing occurs the quickest due to direct exposure to cold air.

Figure 2:
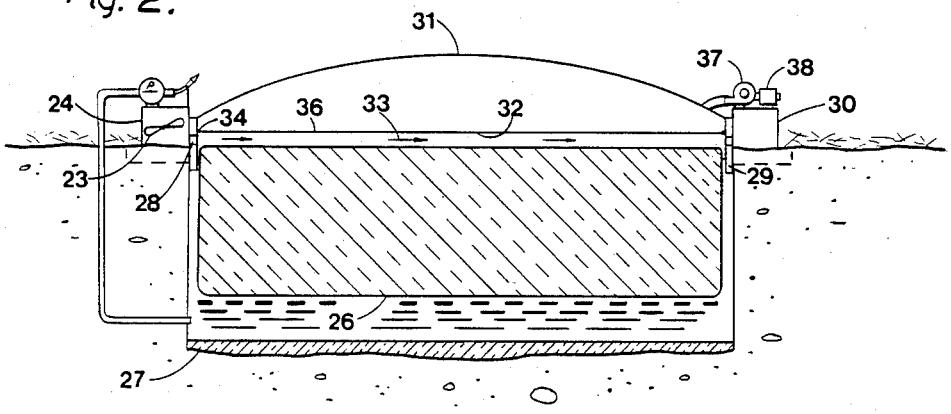
FIG. 2. is a cross-sectional view of a similar excavation as that in FIG. 1. but having an air supported covering.
Figure 10:
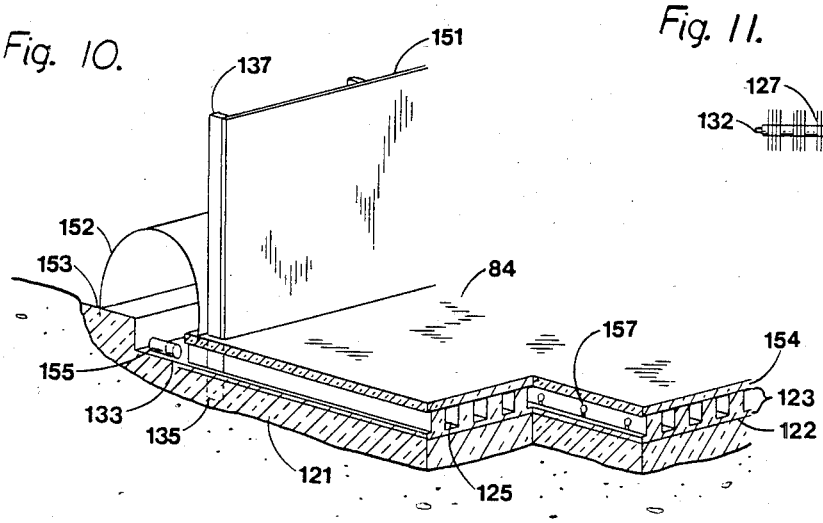
FIG. 10 is a perspective cut-away detailed view of the air-intake, dasher board, and the ice rink surface and sub-surface.

FIG. 2 shows an arrangement for freezing and storing salt water, the same as in FIG. 1, which instead of using salt water as the circulating coolant, uses air which is circulated by a fan 23 through an insulated air return duct 24 running along one side of excavation 27, through holes 28 in the fender boards 29, over the frozen salt water 26, through holes 28 in in the fender boards 29 on the opposite side of the excavation 27, into an insulated air supply duct 30 which runs along an opposite side of the excavation 27 to the air return duct 24, and through the air supply duct 30 to the skating rink shown in FIG. 10. Ice is built up in the excavation 27 the same way as in the excavation of FIG. 1, however, instead of using straw and polyethylene for insulation as in FIG. 1, an outer air supported structure 31 or tent made of conventional materials, and secured in a conventional way, is placed over the excavation 27 during the warm weather months. An inner air supported layer 32 confines the circulating coolant air 33 to directly over the surface of the frozen salt water 26 and is also supported by the circulating coolant air 33. The inner air supported layer 32 may be a flat polyethylene sheet or other suitable material which is secured at the edges by conventional clamps 34 which are currently in wide use to secure green house coverings. The inner air supported layer 32 has an upward facing layer of aluminum foil 36 which reflects radiant heat coming from the outer air supported structure 31. An inflation blower 37 and dehumidifier 38 keeps the outer air supported structure 31 inflated with dehumidified air in order to prevent condensation from forming on the aluminum foil 36.

Figure 3:
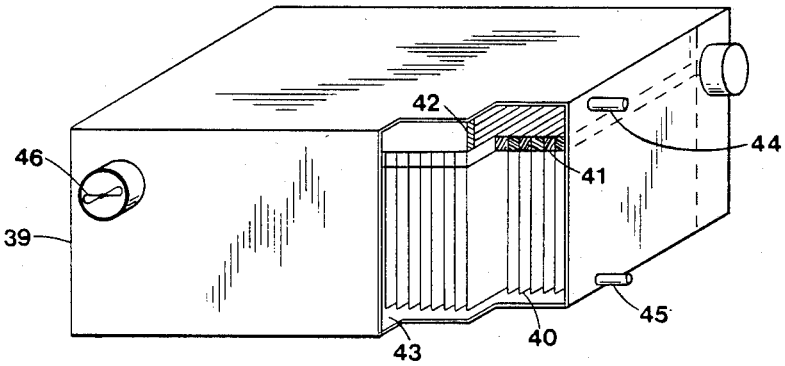
FIG. 3. is a perspective cut-away view of a heat transfer unit through which cold salt water is circulated to cool air which is then used as a refrigerant under an ice rink surface.
Figure 5:
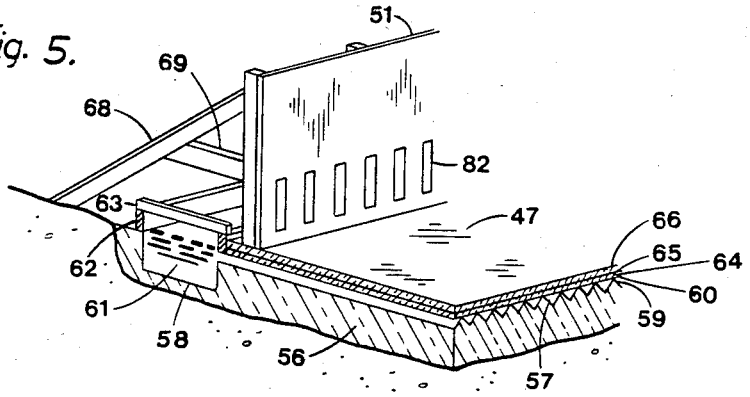
FIG. 5. is a perspective cut-away detailed view of the header box attached to the dasher boards, and the coolant channels under the ice surface.

FIG. 3 shows a heat transfer unit 39 which allows the cold salt water based refrigeration system of FIG. 1 to be used to cool the ice surface of FIG. 10 which is based on the circulation of cold air. In addition it is used to provide cold air to circulate over the top of the skating surface of FIG. 5. The heat transfer unit 39 consists of a plywood box having an inner surface which is coated with fiberglass 43 for water resistance. Sheets of rot-proof fabric 40 are sandwiched between fiberglass supports 41 which are screwed into support beams 42 at both ends. Cold salt water is pumped from the excavation of FIG. 1 through a water inlet pipe 44 flooding the fiberglass supports 41 in the top of the heat transfer unit 39. The cold salt water then runs down between the fiberglass supports 41, over the rot-proof fabric 40, and out a water outlet pipe 45 and back to the excavation of FIG. 1. Air which is used as a coolant under the ice surface of FIG. 10 and over the ice surface of FIG. 5 is circulated by a fan 46, or blower, into the side of the heat transfer unit 39, between the rot-proof fabric 40 where it is cooled by the cold salt water running down the fabric sheets, and out the other side of the heat transfer unit where it then circulates through the ice rink surface of FIG. 10 or over the ice surface of FIG. 5 and back to the heat transfer unit 39. The main purpose of using the refrigeration means of FIG. 1 with the heat transfer unit of FIG. 3 instead of the refrigeration system of FIG. 2, when supplying refrigeration to the ice rink of FIG. 10, is to avoid the cost of the air supported structure of the system shown in FIG. 2. Additionally, heat transfer can be more efficient in the heat transfer unit of FIG. 3 because the fabric sheets 40 can expose more surface area for heat transfer and because the cold air layering effect which occurs over the horizontal surface of frozen salt water of FIG. 2 does not occur with the vertical fabric sheets 40 of the heat transfer unit 39 of FIG. 3.

Figure 4:
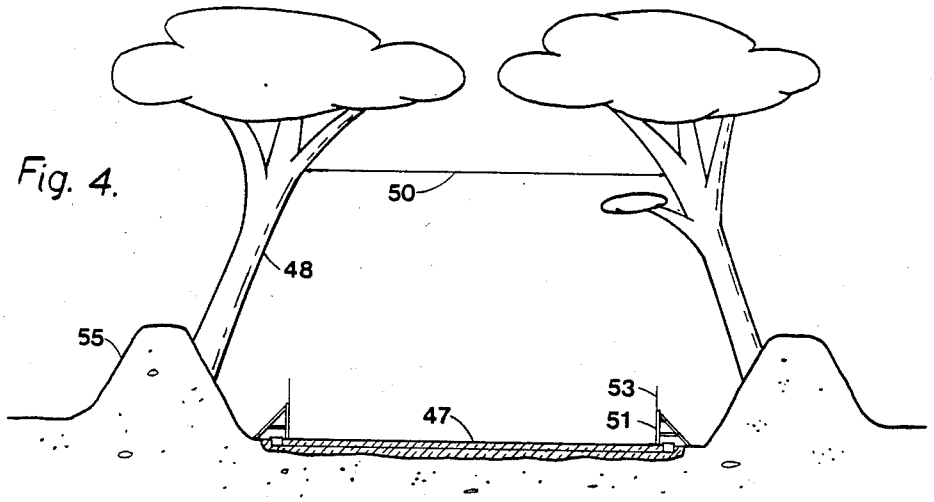
FIG. 4. is a cross-sectional view of an outdoor uncovered ice rink which is covered only by tree branches.
Figure 6:
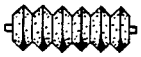
FIG. 6. is a front elevation of a cutter roller used in making the ice channels shown in FIG. 5.

FIG. 4 shows an uncovered outdoor ice rink 47 which is designed to be in operation the year round. The ice rink 47 is protected from direct sunlight by trees 48, which may be grouped over the ice rink 47 by cable 50 secured between the trees 48. The ice rink 47 is surrounded by conventional side boards 51, which besides being used as "dasher boards" for hockey, serve the purpose of holding an insulating layer of cold stratified air in place over the ice rink 47 surface. Transparent panels 53 may be added above the side boards 51, to further confine cold stratified air over the ice rink 47 without hindering the visibility of skaters and observers as is common practice. It is not common, however, to see year round outdoor ice rinks and for such a rink to be successful the skating surface must be isolated from the circulation of moist warm air which otherwise would condense and freeze on the ice surface putting a tremendous heat load on the ice and making it necessary to scrape the accumulated frost off periodically. To form a much more effective barrier around the ice rink 47 dirt may be scraped from where the ice rink will be built into a ridge 55 around the perimeter of where the ice rink will be built. The dirt ridge 55, besides holding a deeper layer of stratified cold air over the ice rink 47, also effectively insulates the cold layer from the warm air on the outside of the dirt ridge 55 and does so without interfering with anyone's view of the ice rink 47. The height of the dirt ridge 55 should be at least 8 feet above the ice rink surface so that skaters will be completely immersed in cold stratified air and will therefore not be able to disturb the stratified cold air layer by their skating motions since it extends above their heads. It is very important to locate the ice rink 47 in as a thick a grove of trees as possible so that there will be little wind at ground level to disturb the stratified layer of cold air over the ice rink 47. The ice rink 47 is of novel design as is shown in the detailed view of FIG. 5. After a reasonably level site has been prepared for the ice rink 47 an ice base 56 is built up during freezing weather and is flooded level to a depth of about 6" over any unevenness of the ground underneath the ice base 56. Channels 57 are then cut in the ice surface across the width of the ice base 56 using a motor driven abrasive cutter having a rotating abrasive drum such as is shown in FIG. 6 which may cut a number of channels at one time. The channels 57 may also be made by spraying more water over the ice base 56 than can completely freeze thus forming an ice slush layer which is then rolled into channels and frozen using a roller resembling the cutter drum of FIG. 6 except for being non-abrasive. The ice base 56 and channels 57 may be made of other materials such as frozen dirt or sand or they may be made more permanent by using a dirt-cement mix or a sand-cement mix in which case the channels 57 would be cut into the cement before it completely hardens. Ice, however, costs practically nothing, is easier to cut, and levels itself.

Figure 7:
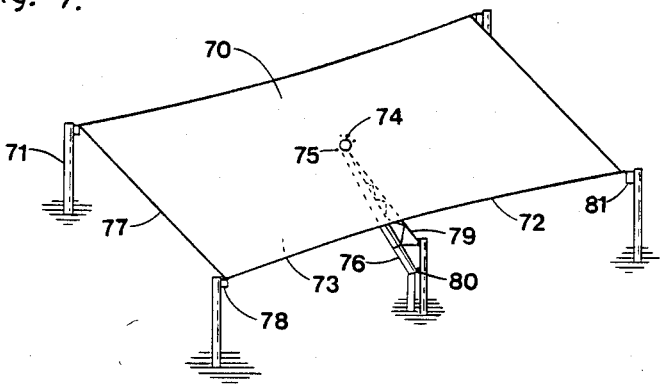
FIG. 7. is an overall perspective view of a roller-reefed covering structure for an outdoor ice rink.

After the channels 57 are cut, headers 58 are cut in the ice base 56 along each side of the length of the ice rink 47 running perpendicular to, and connecting to, the channels 57. A lower layer of polyethylene sheet 59 or other waterproof material, taped or glued at the seams, is then spread out over the channels 57 and headers 58 of the ice base 56. Salt water 61 is then flooded over the lower polyethylene layer 59 until the headers 58 and channels 57 are filled to the top. An upper layer of polyethylene 60 is then spread over the salt water 61 and is secured at its edges by ridge boards 62 which are secured by braces 63. About a ½ in. layer of ice 64 is then frozen over the upper polyethylene layer 60, the ice rink 47 is completely covered with a layer of reflective aluminum foil 65, and then an additional inch or so of ice is frozen over the aluminum foil 65 forming the final skating surface 66. Side boards 51 are secured along the perimeter of the ice rink 47 by a header box 68 and a header brace 69 which also insultes and covers the headers 58. To cool the ice rink 47 the salt water 61 is pumped into the header 58 on one side of the ice rink 47 from which it runs through the channels 57 under the skating surface 66 and into a header 58 on the other side of the ice rink 47. It is desirable that the channels 57 be triangular in shape and spaced as close as possible to allow the salt water 61 to contact the entire lower side of the skating surface 66 and to provide a maximum area for coolant to flow under the ice surface 66. During times when warm humid weather puts an excessive heat load on the ice, cold sub-freezing air may be circulated from the heat exchanger of FIG. 3 through the header box 68 and then through slits 82 along the bottom of the side board 51 where it flows out across the skating surface 66 and then is drawn into the header box 68 on the other side of the rink and back to the heat exchanger of FIG. 3. The sub-freezing layer of air maintained over the ice surface in this manner not only absorbs heat from the ice by convection but it also prevents any condensation from freezing on the ice surface because the ice will be warmer than the air above it. This ice rink design is ideal for use with the refrigeration means of FIG. 1, however, it may also be used with conventional refrigeration plants. To successfully maintain an outdoor ice rink in summer weather it is obvious that it must be shaded from the sun, however, the advantage of using trees to shade the rink instead of a standard roof structure are not so obvious. Besides the attractive outdoor atmosphere created by the trees, they also reduce the heat load on the ice by radiating less strongly to the ice due to the fact that their lower leaves remain much cooler than a conventional roof structure will during sunny weather.

Where large trees are not available the ice rink of FIG. 4 may be covered by a standard roof structure with open sides or a structure such as is shown in FIG. 7 where a waterproof fabric covering 70 is suspended by posts 71 over the ice rink. The fabric covering 70 is secured to and supported along its length by side cables 72. The fabric covering 70 becomes narrower in width toward its middle so that the side cables 72 can put even tension on the fabric covering 70 along its entire length. The fabric covering 70 may have a lower surface of low emissivity high reflectivity aluminum foil 73 or aluminum foil embossed on polyethylene in order to limit the fabric covering 70 from radiating heat down onto the ice rink below. The fabric covering 70 has a drain hole 74 in its middle to drain off rain water and has rings 75 sewn around the drain hole 74 for clipping on and off a drain hose 76 made of water proof fabric and supported by a hinged truss beam 79 which drains away the water from the fabric cover 70 to the side of the rink. One end of the fabric cover 70 is secured to a standard type roller cable 77, such as commonly used on sailboats, which is operated by reversible electric roller reefing winches 78. When it is desirable to remove the fabric cover 70 from over the ice rink the drain hose 76 is first unclipped from the fabric cover 70 and the hinged truss beam 79 is pivoted on its hinges 80 over to the side of the ice rink. Then the roller reefing winches 78 are activated in the direction that rolls the fabric cover 70 upon the roller reefed cable 77 while at the same time electric cable winches 81 at the other end of the fabric cover 70 allow the cable to run out until the fabric cover 70 is completely wound on the roller reefed cable 77. This process is reversed in order to deploy the fabric cover 70. The main advantage of this system over a permanent roof is that besides being less expensive it allows the rink to be uncovered every evening for lighted night skating under the moon and stars. It also allows the rink to be uncovered during cloudy cool days, and through most of the winter which provides an attractive outdoor setting which will bring out many general skaters.

The rink should be covered whenever the sun is shining brightly during mild weather and should also be covered when it is raining. Uncovering the rink during mild clear nights has the added advantage of allowing heat from the ice surface to radiate off into space.

Figure 8:
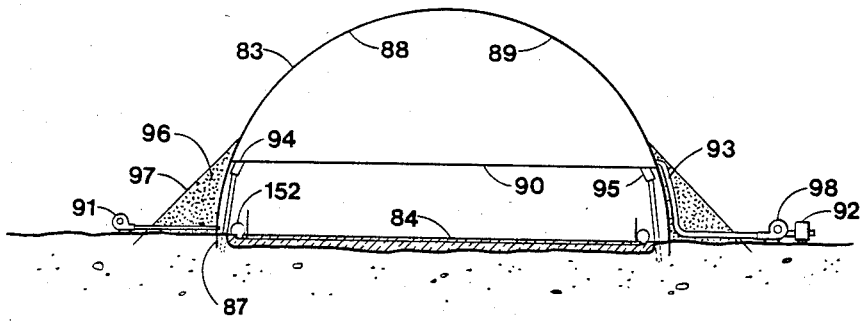
FIG. 8. is a cross-sectional view of an air-supported covering for an indoor ice rink which has a secondary air supported structure therein.

FIG. 8 shows a conventional air-supported structure or "bubble" 83 placed over a novel ice rink 84 in which cold air is circulated through the air duct 152 along one side of the rink 84, under the ice rink 84 and back through the air duct 152 along the opposite side of the rink 84 as is later shown in FIG. 10. The bubble 83 may be secured at its edges 87 to a conventional foundation, however, it is preferable to simply bury the edges 87 of the bubble in the ground and freeze them there as is shown in FIG. 8 because this saves the cost of a foundation and prevents air leakage from under the edges 87 of the bubble. To further prevent air leakage the bubble 83 is sealed on its inner surface with a polyethylene film liner 88 which is taped at its seams and also is frozen into the ground at its lower edges. Taking pains to completely seal the bubble 83 from air leakage is an important part of this invention because keeping the heat load on the ice surface to a minimum is essential when using the relatively warm coolant temperature of this invention and by sealing the bubble 83 from air leakage, the need to continuously be pumping warm moist air into the bubble 83 is eliminated along with the heat load of condensation which the warm moist air puts on the surface of prior art ice rinks. The prior art ice rinks describes the use of aluminum foil attached to the inner surface of a bubble structure to reduce radiant heat load on the ice by making use of the low emissivity of the aluminum foil. The aluminum, however, is subject to deterioration because on sunny days hot air collects in the top of the bubble and the sudden cooling of the bubble surface at sunset causes condensation to form on the aluminum causing it to oxidize which more than doubles its emissivity to the ice surface below. In this embodiment the bubble 83 has the usual inner surface of bare aluminum foil 89, however, it also has an inner air supported structure 90 of translucent polyethylene taped at its seams with transparent greenhouse repair tape and taped or otherwise secured to either side of the bubble 83 at a height of about 10 to 12 feet. The bubble 83 is maintained by a primary blower 91, a secondary blower 98, and dehumidifier 92 which supplies dehumidified air through an air hose 93 to the space above the inner air-supported structure 90 which reduces condensation and deterioration of the aluminum foil 89. The inner air supported structure 90 has patches of clear plastic material 94 taped around its edges so that lights 95 can shine up through the patches of clear plastic material 94 and against the aluminum foil 89. The aluminum foil 89 then reflects the light back down and through the translucent polyethylene 90 which completely disperses the light falling on it. This method of lighting gives the impression of a bright over-cast day to the skaters using the rink 84 while hiding the aluminum foil 89 from view. The lower surface of the polyethylene 90 should be sanded or otherwise roughened so that reflections of the skaters cannot be seen in it. The translucent polyethylene 90 is supported in a horizontal position by balancing the amount of air pumped in by the primary blower 91 and the secondary blower 98.

Many cities collect great quantities of leaves from their parks and from the local residents which can be had from them for free and in this invention the leaves 96 are pilled around the sides of the bubble 83 to a height of about two feet over where the inner air-supported structure 90 is attached to the bubble 83. A waterproof tarpaulin 97 is tape, glued, sewn or otherwise attached to the bubble 83 above the leaves 96 and is draped over the leaves 96, protecting them from rain and wind and then is secured to the ground by stakes or by being buried in the dirt. The leaves 98 provide insulation not only to the skating area but also to the frozen dirt which forms the foundation for bubble 83. Where leaves are not available the sides of the bubble must be insulated with some other material up to a point above the inner air-supported structure 90 otherwise it will radiate heat down to the ice which enters through the uninsulated side walls of the bubble 83.

Figure 9:
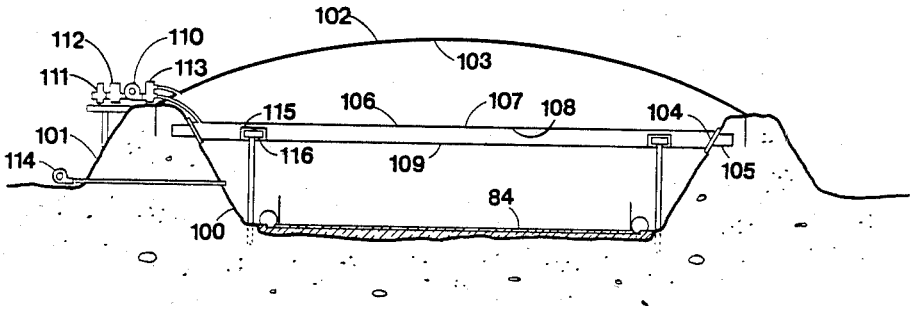
FIG. 9 is a cross-sectional view of an air-supported covering for an indoor ice rink which has a middle and lower air-supported structure therein.

FIG. 9 shows an ice rink 84 of the same type as shown in FIG. 8 and FIG. 10 which is disposed into an excavation in the ground 100 the dirt from which has been piled up into a dirt ridge 101 around the perimeter of the excavation 100. An outer air-supported structure 102 or bubble of conventional materials covers the ice rink 84 and is secured to the top of the dirt ridge 101 by a conventional foundation or is simply buried in the dirt. The bubble 102 has an inner lining 103 of black polyethylene which, besides sealing the bubble 102 from air leakage, also prevents any sunlight from penetrating the bubble 102. The dirt ridge 101, besides providing insulation to the cold air over the skating rink 84, also allows the use of a much lower bubble 102 which consequently catches less wind force and therefore does not have to be made of such a strong or expensive material as is usual. Side panels 104 are secured to the dirt ridge 101, by braces 105 at least 10 feet over the ice rink 84. A central air-supported layer 106, of polyethylene or similar airtight material, having an upward facing surface of aluminum foil 107 is secured at its edges to the side panels 104 by tape, greenhouse film clamps or both. The aluminum foil 107 is highly reflectant of radiant heat and reflects about 97% of the heat falling on it from the bubble 102 above. As was mentioned earlier, the bubble 102 should absorb all visible light that falls on it in order to minimize the radiation that falls on the aluminum foil 107. An important advantage of this system is that the temperature of the aluminum foil 107 and the air in contact with it will remain virtually constant which besides reducing the stress on the inelastic aluminum foil, also prevents the possibility of condensation forming on and deteriorating the aluminum foil 107 as can happen when aluminum foil is used on the inside surface of a prior art bubble which fluctuates greatly in temperature through the day and night. Condensation, of course, oxidizes the aluminum reducing its reflectivity and increasing its emissivity. It is desirable to add a downward facing layer of aluminum foil 108 to the middle air-supported layer 106 to further reduce in half emissions to the ice rink 99 below. This is possible because of the 3% of heat absorbed by the upward facing aluminum 107, half will be re-radiated downward to the ice surface 99 by the downward facing layer of aluminum foil 108 and the other half will be re-radiated harmlessly back to the outer air-supported structure 102 by the upward facing surface of aluminum foil 107. A lower air-supported layer 109 of translucent polyethylene may be attached to the side panels 104 by tape, greenhouse film clamps or both, a couple of feet below the central air-supported structure 106. This serves, for one thing, to isolate the downward facing aluminum foil 108 so that a secondary blower 110 can supply dehumidified air through a filter 111, dehumidifier 112, and adjustable distributing valve 113 to the space above and below the central air-supported layer 106 in order to further preserve the surface of the upward facing aluminum 107 and the lower facing aluminum 108. The adjustable distributing valve 113 controls air flow in order to supply the right amount of air above and below the central air-supported layer 106. A primary blower 114 supplies air to the skating area. Recesses 115 made of clear plastic are taped into the lower air-supported layer 109 and contain lights 116 which shine through the clear plastic recesses 115 and out over the downward facing aluminum 108 which reflects the light down through the translucent polyethylene 109 which in turn provides warm glare-free illumination of the ice rink 84 below. When putting up the central and lower polyethylene sheets 106 and 109 it is helpful to tape a few extra feet of polyethylene along their edges so that they will hang loose when attached to the side panels 114, then inflate the area below and pull out the slack in the polyethylene sheets 106 and 109 and attach them permanently to the side panels 104.

Figure 11:
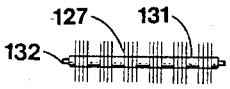
FIG. 11 is a front elevation of a cutter blade used to saw channels in the ice surface of FIG. 10.

The ice rink of FIG. 8 and FIG. 9 is of novel design and is shown in detail in FIG. 10. An ice base 121 is built up during freezing weather and is flooded level and frozen to a depth sufficient to cover any unevenness of the ground underneath the ice base 121. A layer of white paint 122 is spread and dried over the ice base 121 and a second layer of ice 123 about 4" thick is frozen over the white paint 122. Channels 125 are then cut in the second layer of the ice 123 across the width of the ice rink 84 using a motor driven cutting unit which has an ice engaging portion as shown in FIG. 11 consisting of a series of conventional rotational blades 127 divided by spacers 131 and mounted on a shaft 132, which cuts a number of channels 125 at one time. The saw blades 127 are spaced closely enough together where each channel 125 is to be cut so that vibration from the saw blades 127 shatters the ice inbetween the closely spaced blades 127. The ice rink 84 is then flooded with water to a depth of about 3" above the top of the channels 125 and all floating ice chips are removed using a screen which is formed into the shape of a wide snow shovel. Then the remaining water which covers the top of the channels 125 to a depth of about 1½" is frozen down to the top of the channels 125 to form the final skating surface 154 of about 1½" of ice. Headers 133 are then cut in the ice along each side of the ice rink 84 and the unfrozen water in the channels 125 is drained off through the headers 133. Holes 135 are then cut in the ice along the sides of the ice rink and inbetween the channels 125, into which braces 137 are frozen with the aid of a little wet snow. Conventional side boards 151 are attached to the braces 137 in the usual way. Air ducts 152 run along both sides of the rink 84 and may be of conventional design or may be simply made of polyethylene sheet with its edges frozen into slits 153 in the ice on either side of the headers 133 as is shown. To cool the ice rink coolant air is circulated from the heat exchanger of FIG. 3 or from the refrigeration supply means of FIG. 2 and through an air duct 152 on one side of the rink 84, through the channels 125 and back through the air duct 152 on the other side of the ice rink 84. The air circulation direction may be reversed periodically if perfectly even cooling of the ice surface is desired. The novel design of the ice rink 84 allows the production of an unique lighting effect where lamps 155, which produce focused beams of light, are placed in the headers 133 around the edges of the rink 84 and are positioned to shine through the channels 125 in order to light the ice rink 84 from within. As the beams of light spread out in the channels 125 they are absorbed by the ice rink 84 and reflected upward by the white paint 122. Strings of colorful Christmas lights 157 may also be strung through the channels 125. The effect of these lights is best when all other lights are turned off.

The main advantage of the above described ice surface is that it costs practically nothing in materials and very little in labor to make. Even the ground that it rests on does not have to be carefully leveled as is necessary with other ice rinks. This ice rink 84 may be used in conjunction with a standard refrigeration plant as well as the coolant means set forth in this invention.

From the foregoing it will be understood that the illustrative embodiments, above described, are well suited to provide the advantages set forth. And since many possible embodiments may be made of various features of the invention and as methods and systems here described may be varied in various parts, all without departing from the scope of the invention, it is to be understood that all matter here and before set forth and shown in the accompanying drawings is to be interpreted as being illustrative and not in a limiting sense in that certain features of these embodiments may be used without a corresponding use of other features without departing from the scope of the invention.

I claim:

1. A structure for selectively providing shade for an outdoor ice rink comprising: a waterproof cover having a downward facing surface of aluminum, support posts for supporting said waterproof cover, positioned at selected distances around the periphery of the ice rink, said waterproof cable providing total shade to the ice rink when in a first position, cable means secured to said waterproof cover at one end thereof and to reversible winch means at the other end thereof for moving the waterproof covering to a second position wherein the cover allows sunlight to strike the ice rink, a drain hole in the waterproof cover and means for conveying water away therefrom.

2. An insulation structure for an outdoor ice rink comprising: a dirt ridge positioned around the periphery of the ice rink, an outer layer of flexible material positioned above said ice rink and secured to said dirt ridge; a central layer of insulation secured to said dirt ridge at a position between the outer layer and the ice rink, said central layer comprised of upward facing and downward facing layers of aluminum foil, means to supply compressed air to said structure and valve means connected thereto to selectively supply compressed air to the space above or below the central insulation layer.

3. The insulating structure as set forth in claim 2 further including a lower layer of translucent material with recesses positioned therein, lights positioned in said recesses wherein they shine upwardly across said downward facing layer of aluminum foil and reflects the light downwardly through said translucent material.

4. The insulating structure as set forth in claim 2 further including an air filter and dehumidifier positioned in said means to supply compressed air upstream of said valve.

* * * * *